US011701674B2

(12) United States Patent
Chen

(10) Patent No.: US 11,701,674 B2
(45) Date of Patent: Jul. 18, 2023

(54) NOZZLE OF A SPRAY GUN AND METHOD FOR SPRAYING FROM SPRAY GUN

(71) Applicant: HUI BAO ENTERPRISE CO., LTD., Changhua County (TW)

(72) Inventor: Wan Pao Chen, Changhua County (TW)

(73) Assignee: Hui Bao Enterprise Co., Ltd., Changhua County (TW)

( * ) Notice: Subject to any disclaimer, the term of this patent is extended or adjusted under 35 U.S.C. 154(b) by 307 days.

(21) Appl. No.: 17/133,894

(22) Filed: Dec. 24, 2020

(65) Prior Publication Data

US 2022/0152635 A1 May 19, 2022

(30) Foreign Application Priority Data

Nov. 13, 2020 (TW) ..... 109139642

(51) Int. Cl.
*B05B 7/08* (2006.01)
*B05D 1/02* (2006.01)

(52) U.S. Cl.
CPC ..... *B05B 7/0823* (2013.01); *B05D 1/02* (2013.01)

(58) Field of Classification Search
CPC ..... B05D 1/02; B08B 3/028; B05B 3/1092; B05B 3/0463; B05B 7/2435; B05B 3/0409; B05B 3/0427
USPC ..... 239/301
See application file for complete search history.

(56) References Cited

U.S. PATENT DOCUMENTS 4,965,893 A * 10/1990 Henkin ..... A61H 33/027 4/492
5,328,097 A * 7/1994 Wesch ..... B05B 1/1645 239/243
6,250,566 B1 * 6/2001 Jager ..... B05B 3/0463 239/263
9,211,560 B1 * 12/2015 Chen ..... B05B 3/06
10,654,077 B2 * 5/2020 Wang ..... B08B 3/026
2015/0266041 A1 * 9/2015 Liao ..... B05B 3/06 239/373
2015/0375272 A1 * 12/2015 Dehn ..... B05B 3/022 15/345
2017/0120266 A1 * 5/2017 Fu ..... B05B 7/064
2022/0134366 A1 * 5/2022 Pieroni ..... B05B 7/066 239/8

* cited by examiner

*Primary Examiner* — Tuongminh N Pham
*Assistant Examiner* — Kevin Edward Schwartz
(74) *Attorney, Agent, or Firm* — Rosenberg, Klein & Lee

(57) ABSTRACT

A nozzle of a spray gun includes an outer part connected to the spray gun. The outer part includes a neck portion formed therein. A neck hole is formed through the neck portion. Multiple paths are defined through the neck portion. The neck portion divides the inner space of the outer part into a first room and a second room. A tube extends through the neck hole and the tube. A swing member is located in the first room and connected to the rear end of the tube. An inner part is located in the second room and connected to the front end of the tube. High pressure fluid is introduced into the first room to swing the swing member. The tube and the inner part swing with the swing member. The high pressure fluid enters into the second room via the paths and spray out from the outer part.

8 Claims, 10 Drawing Sheets

(a)

(b)

(c)

(d)

NOZZLE OF A SPRAY GUN AND METHOD FOR SPRAYING FROM SPRAY GUN

BACKGROUND OF THE INVENTION

1. Fields of the Invention

The present invention relates to a spray gun, and more particularly, to a nozzle for spraying high-pressure liquid of a spray gun.

2. Descriptions of Related Art

U.S. Pat. No. 9,751,098B2 discloses a Gyrating nozzle spray gun, and includes a grip including an air inlet, a valve seat, a gas-delivery tube connected to the valve seat and terminating in a mating connection portion and a trigger operable for letting external compressed air go into the air inlet and the gas-delivery tube, an attachment tube connected to the mating connection portion of the gas-delivery tube, and a gyrating pattern generator including a gas-supply tube connected to the mating connection portion and suspended in an accommodation chamber, a bearing mounted on a connecting portion, a coupling socket mounted on an outer race and a gyrating nozzle fastened to the coupling socket and rotatably disposed in an orifice and defining a gas accumulation chamber and an oblique jet hole for ejection of the intake flow of compressed air that goes through the air inlet, the gas-delivery tube and the gas-supply tube into the gas accumulation chamber. However, the spraying angle of the spray gun mentioned above is too small and therefore reduces work efficiency.

Taiwanese Utility Model No. TWM486493 discloses a spray gun which includes a rotatable member with a bearing, and the rotatable member is connected to a front end of a Venturi-tube. The nozzle structure for both of the U.S. Pat. No. 9,751,098B2 and TWM486493 is complicated and high manufacturing cost. Besides, the nozzles are not replaceable. It is noted that the rotatable member of TWM486493 is smaller than that of U.S. Pat. No. 9,751,098B2, so that the spray gun of TWM486493 includes a blind area that the spray gun cannot reach.

Furthermore, TWM472566 discloses a spray gun as disclosed in FIG. 10, wherein multiple weights 10 are connected to the Venturi-tube 7 so restrict the swing angle of the outlet 71 of the Venturi-tube 7 so as to avoid a blind area 9 when using the spraying gun. However, the weights 10 may hit the inside of the cone-shaped outer part 8 to generate noise. The Venturi-tube 7, the cone-shaped outer part 8 and the weights 10 may crack and damaged, this increases maintenance expanse.

The present invention intends to provide a nozzle of a spray gun and eliminates shortcomings mentioned above.

SUMMARY OF THE INVENTION

The present invention relates to a nozzle of a spray gun, and comprises an outer part which is connected to the front outlet of the spray gun and includes a neck portion formed therein. A neck hole is formed through the neck portion, and multiple paths are defined through the neck portion of the outer part and located around the neck hole. The neck portion divides the inner space of the outer part into a first room and a second room. A tube extends through the neck hole of the outer part, the tube located in the second room, and the tube located in the first room. A swing member is located in the first room of the outer part and connected to the rear end of the tube. An inner part is located in the second room and connected to the front end of the tube. When high pressure fluid is introduced into the first room, the swing member swings by the high pressure fluid, and the tube and the inner part swing with the swing member. The high pressure fluid enters into the second room via the multiple paths and spray out from the outer part.

The present invention provides a method of spraying from a nozzle of a spray gun, and comprises the following steps:

a step of forming rooms: providing an outer part connected to the spray gun, the outer part having a first nozzle which is a cone-shaped nozzle, the outer part having a neck portion which includes a neck hole, and multiple paths are located around the neck hole, the neck portion dividing the inner space of the outer part into a first room and a second room;

a step of installing a swing member: extending a tube through the neck hole, a swing member connected to the rear end of the tube, an inner part connected to the front end of the tube, the swing member including multiple wings extending from the outer surface thereof, the swing member including a cone-shaped way defined therethrough, a Venturi-tube extending through the front outlet of the spray gun, the cone-shaped way and the tube, and a step of introducing high pressure liquid: providing a head part formed to the front end of a barrel of the spray gun, the head part including multiple bores which communicate with the front outlet so as to introduce high pressure liquid into the first room via the bores, and to introduce high pressure liquid into the second room via the paths, the high pressure liquid introduced in the first room driving the swing member to swing, the tube and the inner part swinging with the swing member, the high pressure liquid introduced in the second room via the paths spraying from the first nozzle.

The advantages of the present invention are that the bores extend inclinedly about 45 degrees so that when the high pressure liquid is introduced into the first room, the high pressure liquid directly apply to the wings of the swing member so as to swing and spin the swing member 360 degrees.

The tube extends through the neck hole of the outer part, and the front end of the tube is located in the inner part, this increases the swing effect to the inner part to avoid the inner part from hitting the outer part, such that no noise is generated.

The inner part includes a second nozzle which is a cone-shaped nozzle, a first cone-shaped part, a second cone-shaped part or a third cone-shaped part, to provide different spraying patterns.

The primary object of the present invention is to provide a nozzle of a spray gun that include a simple structure and performs multiple spraying patterns.

Another object of the present invention is to provide a nozzle of a spray gun that does not generate noise when in use.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
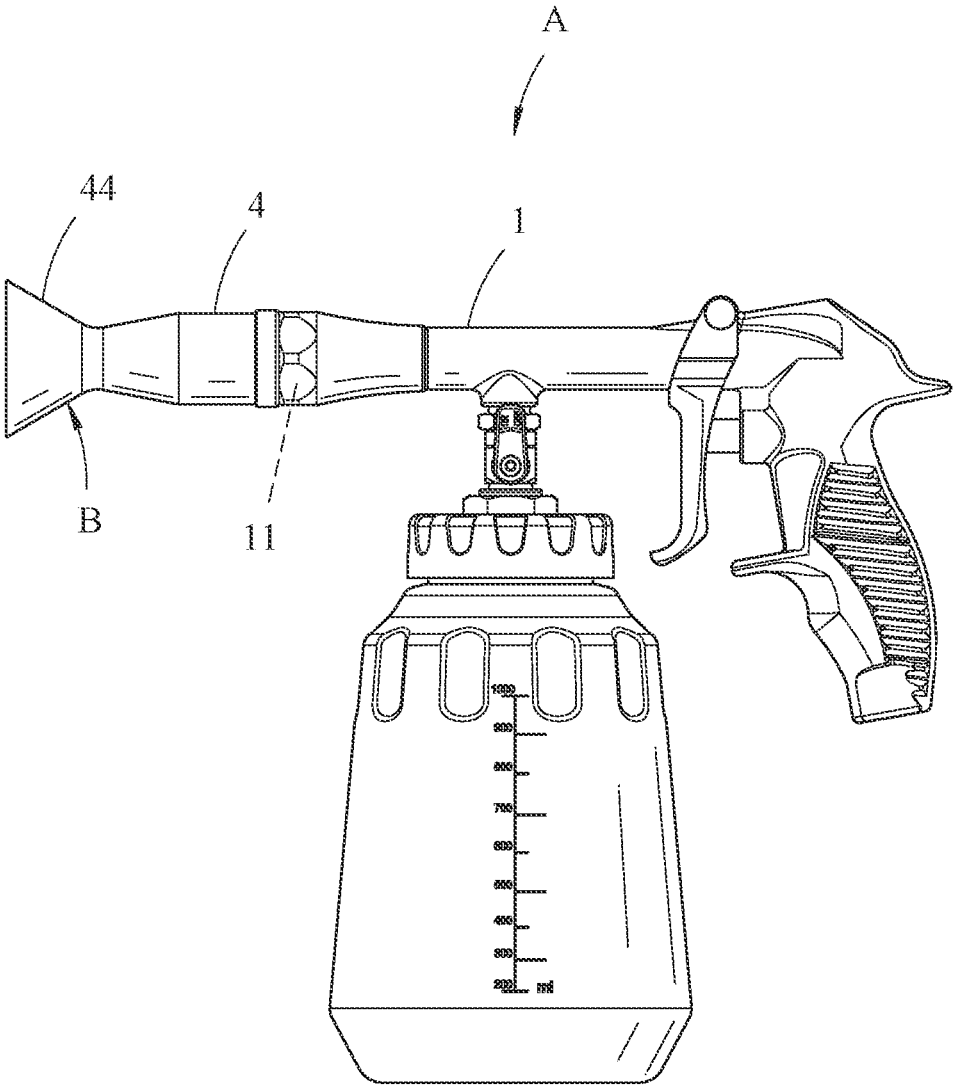
FIG. 1 is a perspective view to show the spray gun of the present invention.
Figure 2:
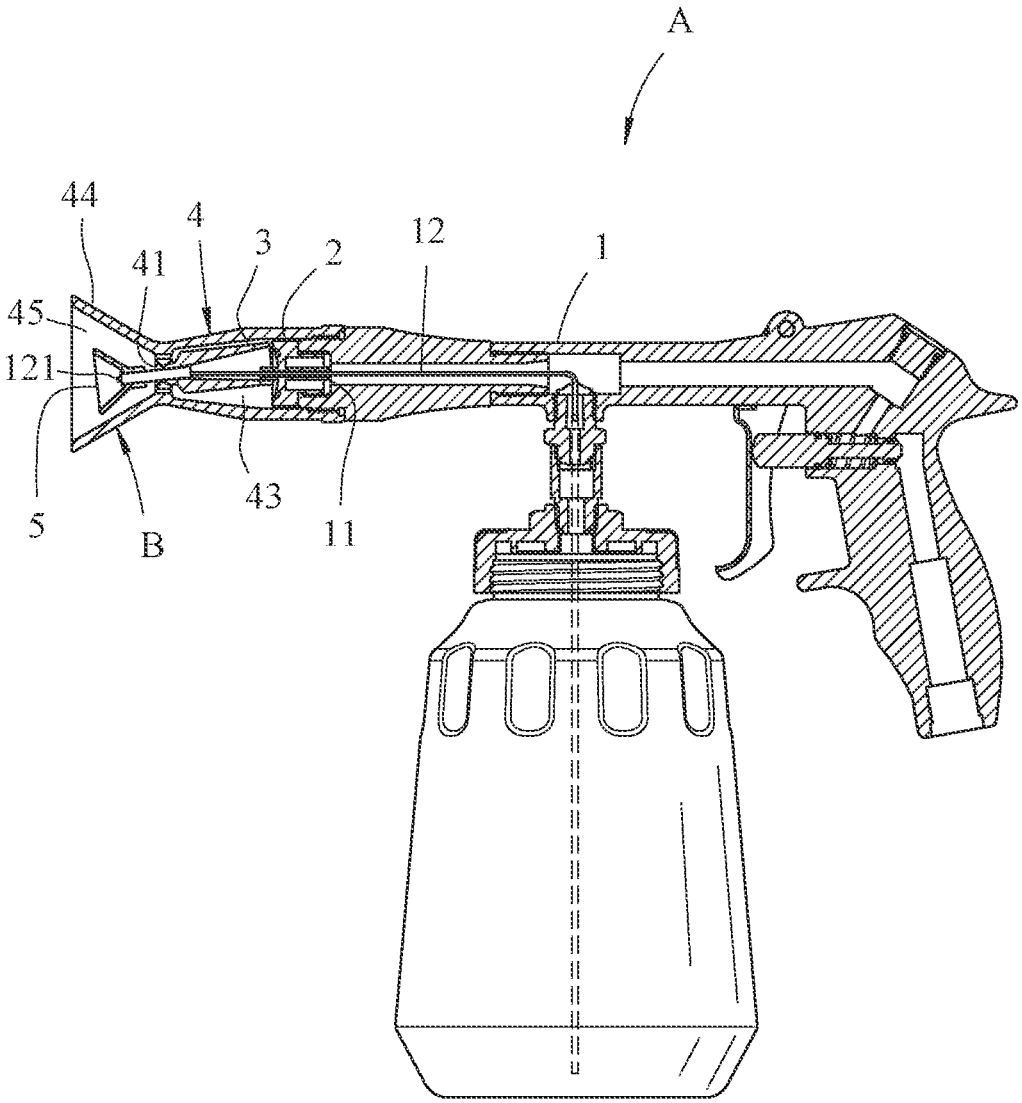
FIG. 2 is a cross sectional view to show the spray gun of the present invention.
Figure 3:
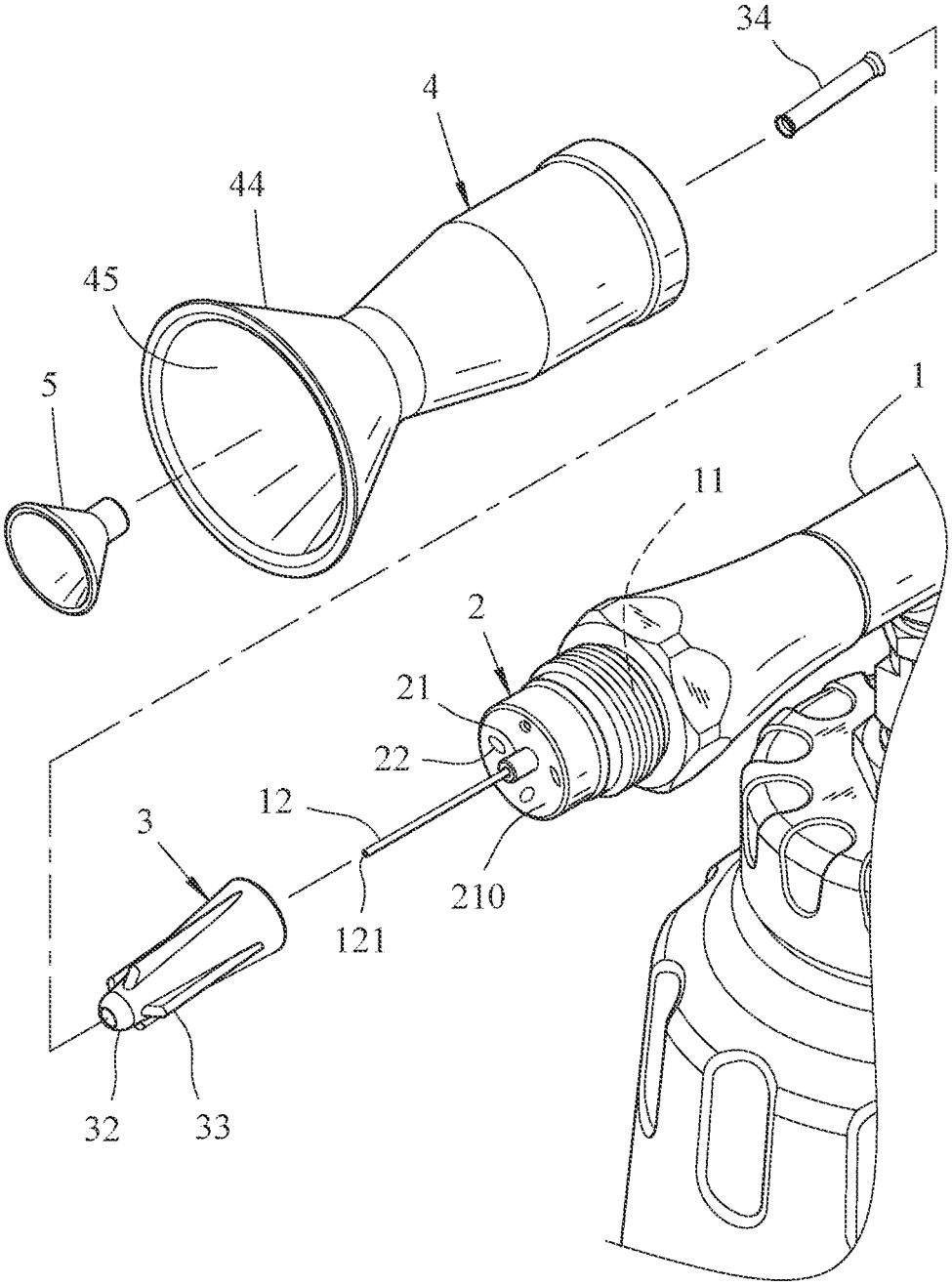
FIG. 3 is an exploded view of the nozzle of the spray gun of the present invention.

Referring to FIGS. 1 to 3, the nozzle "B" of a spray gun "A" of the present invention is connected to the front outlet 11 of the spray gun "A", and comprises a head part 2, a swing part 3, an outer part 4 and/or an inner prat 5.

Figure 4:
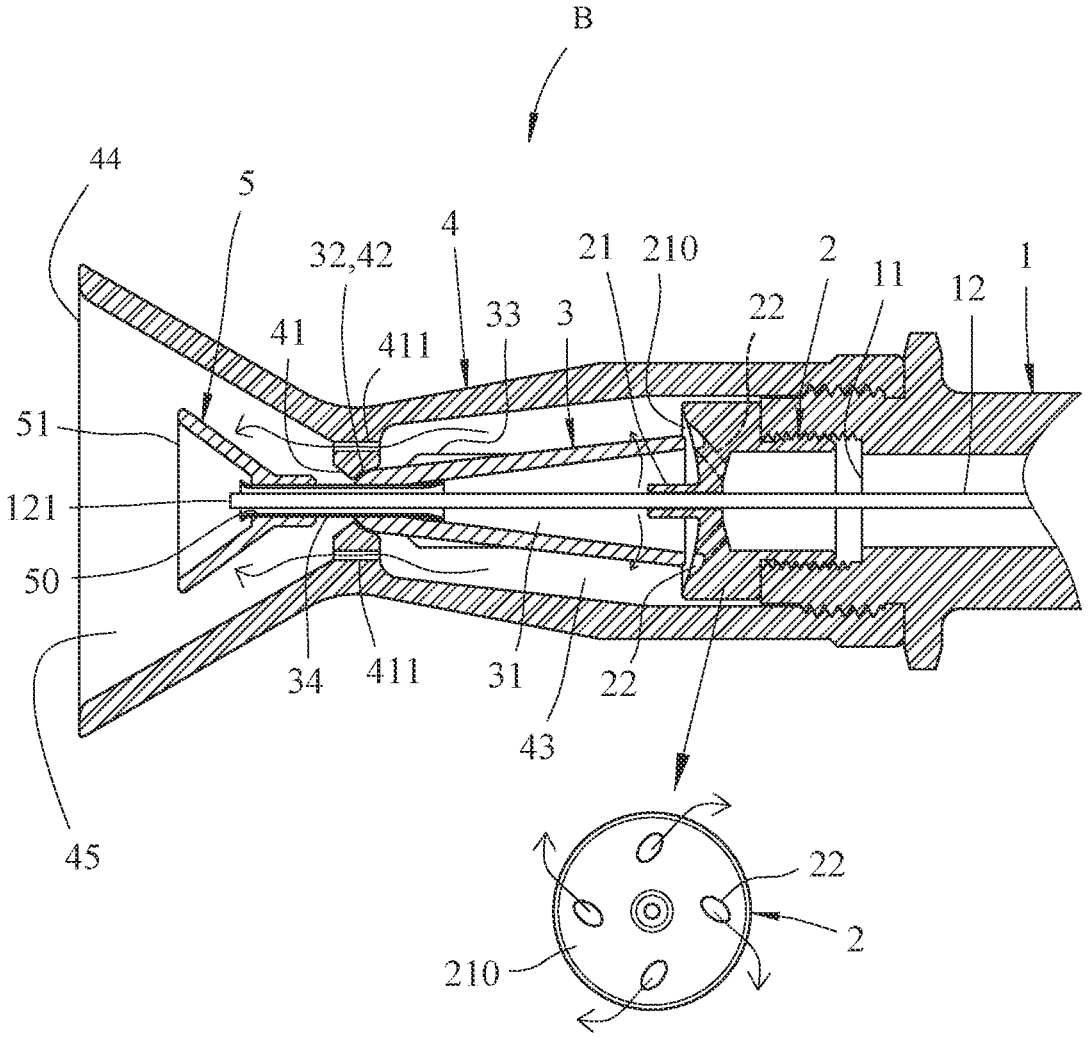
FIG. 4 is an enlarged cross sectional view to show the nozzle of the spray gun of the present invention.

As shown in FIGS. 3 and 4, the head part 2 is formed to the front outlet 11 of the spray gun "A" and includes". The head part 2 is located between the front outlet 11 and the outer part 4. The head part 2 includes a recessed area 210 defined in the front end thereof. A tubular portion 21 extends from the center of the recessed area 210, and multiple bores 22 are formed in the front end of the head part 2 and located around the tubular portion 21. The bores 22 each extends 45 degrees relative to the axis of the head part 2.

The swing member 3 includes multiple wings 33 extending from the outer surface thereof. The swing member 3 includes a cone-shaped way 31 defined therethrough. A Venturi-tube 12 extends through the front outlet 11 of the spray gun "A" and the cone-shaped way 31. The swing member 3 includes a ball head 32 on the front end thereof. The ball head 32 is connected to the rear end of the tube 34 which is made of metal.

The outer part 4 is connected to the front outlet 11 and includes a neck portion formed therein. A neck hole 41 is formed through the neck portion. Multiple paths 411 are defined through the neck portion of the outer part 4 and located around the neck hole 41. The neck portion divides the inner space of the outer part 4 into a first room 43 and a second room 45. The swing member 3 is located in the first room 43 and connected to the rear end of the tube 34 which extends through the neck hole 41 of the outer part 4. The front end of the tube 34 is located in the second room 45, and the rear end of the tube 34 located in the first room 43. The neck portion includes a ball-shaped recess 42 in which the ball head 32 of the swing member 3 is rotatably engaged. The outer part 4 includes a first nozzle 44 which is a cone-shaped nozzle.

Figure 7:
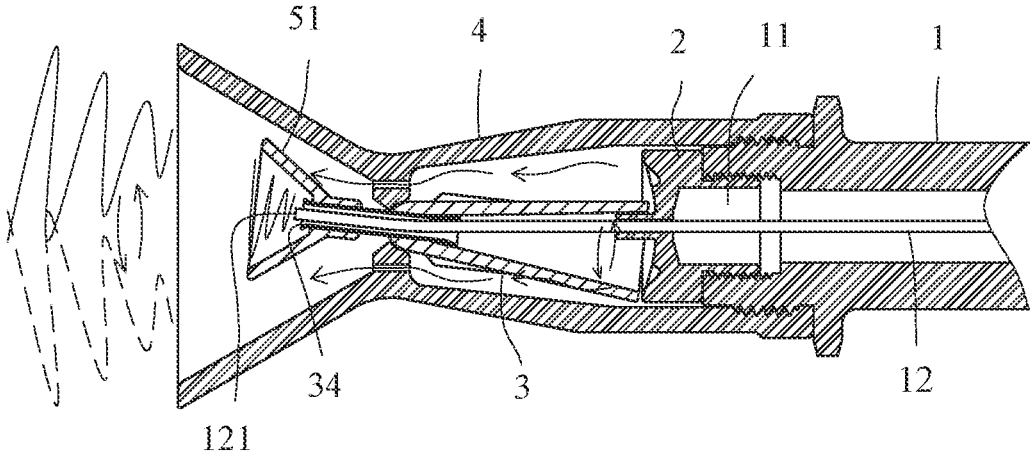
FIGS. 7 (*a*) and (*b*) show different spray patterns of the spray gun of the present invention.
Figure 7:
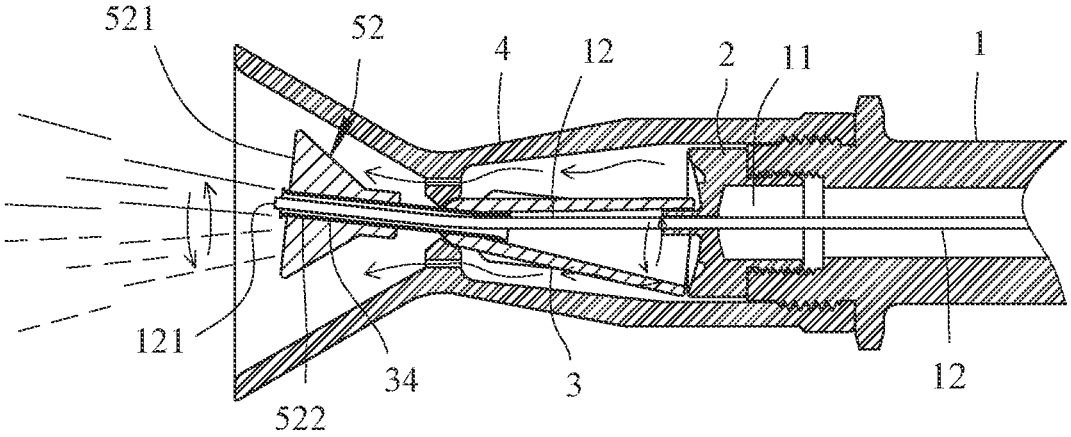

The inner part 5 is located in the second room 45 and connected to the front end of the tube 34. Preferably, the front end of the tube 34 protrudes beyond the through hole 50 of the inner part 5. The open end 121 of the Venturi-tube 12 protrudes beyond the front end of the tube 34 for 1 to 2 mm to have better atomization feature. As shown in FIGS. 7 (*a*), (*b*) and FIGS. 8 (*c*), (*d*), the inner part 5 includes a second nozzle 51 which is a cone-shaped nozzle, a first cone-shaped part 52, a second cone-shaped part 53 or a third cone-shaped part 54. The users can choose one of the second nozzle 51 and the parts 52, 53, 54 to use.

Figure 5:
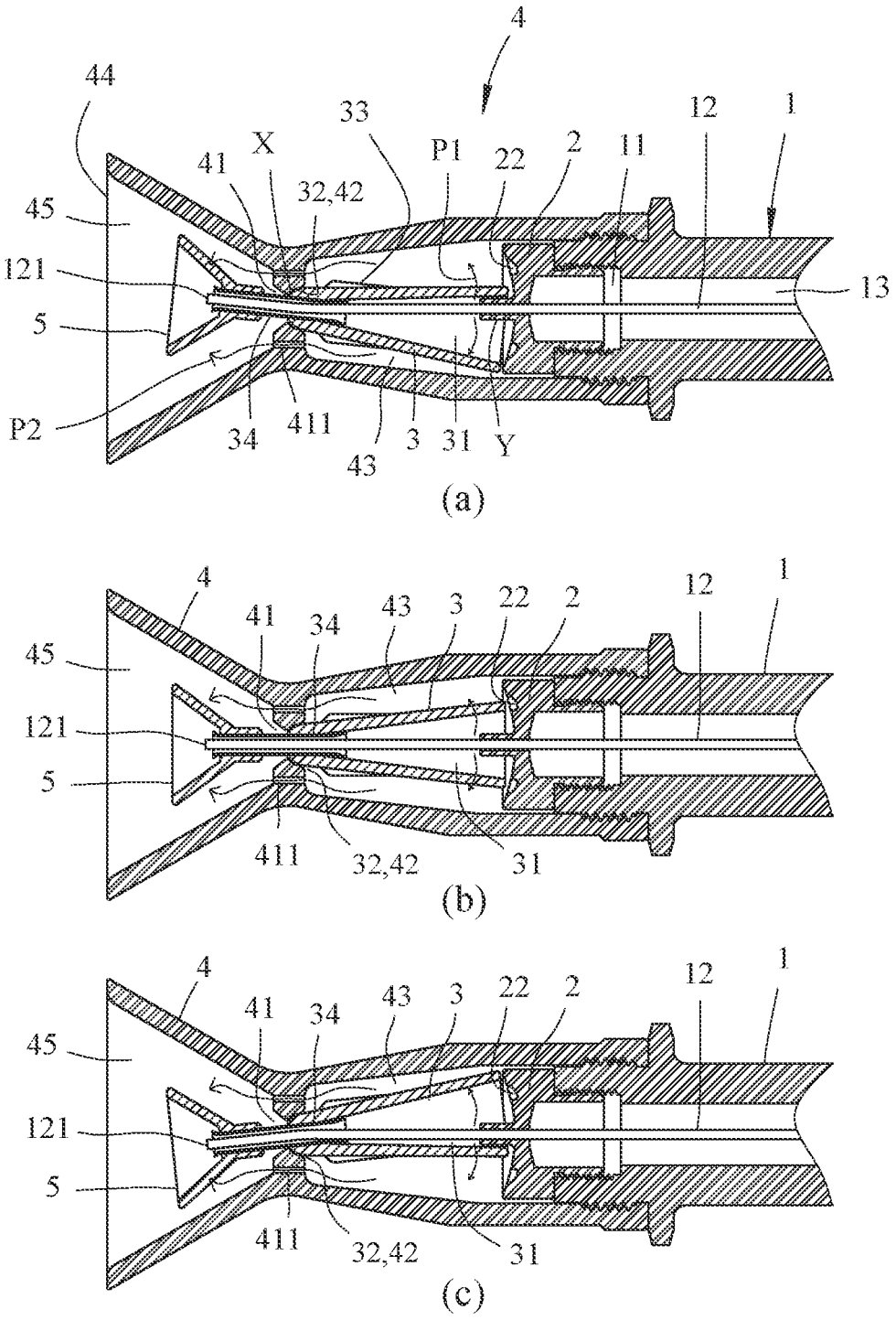
FIGS. 5 (*a*) to (*c*) show the spraying action of the spray gun of the present invention.
Figure 6:
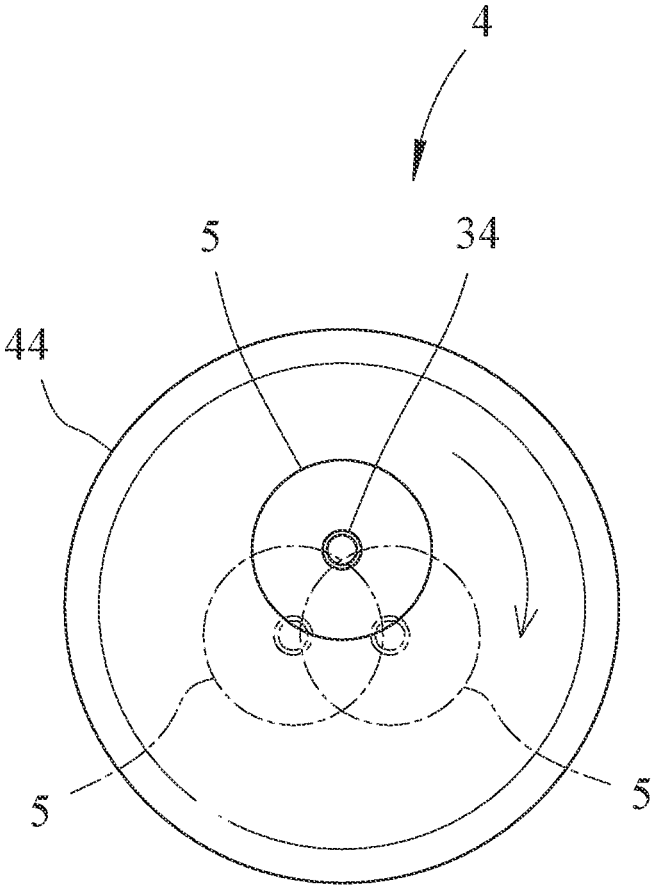
FIG. 6 is a front view to show the inner part move in the outer part of the spray gun of the present invention.

As shown in FIGS. 4 to 6, by engaging the ball head 32 of the swing member 3 with the ball-shaped recess 42 of the outer part 4, and by inserting the tubular portion 21 of the head part 2 in the cone-shaped way 31 of the swing member 3. When high pressure fluid is introduced into the first room 43 via the bores 22, the swing member 3 swings by the high pressure fluid, and the tube 34 and the inner part 5 swing with the swing member 3 as shown in in FIGS. 5(*a*), 5(*b*) and 5(*c*). The high pressure fluid enters into the second room 45 via the multiple paths 411 and spray out from the open end 121 of the Ventrui-tube 12 and the outer part 4.

Specifically, a first force P1 is formed by the high pressure liquid entered into the first room 43 via the bores 22, and the first force P1 drives the wings 33 of the swing member 3 so that the swing member 3 swings between two points "X", "Y". A second force P2 is formed by the high pressure liquid entered into the second room 45 via the paths 411 of the outer part 4, the second force P2 sucks atomized liquid from an open end 121 of the Venturi-tube 12. The users may choose the second nozzle 51, the first cone-shaped part 52, the second cone-shaped part 53 or the third cone-shaped part 54 to have different spraying patterns.

The method of spraying from the nozzle "B" of the spray gun "A" comprises the following steps:

a step "a" of forming rooms: providing an outer part 4 connected to the spray gun "A", the outer part 4 having a first nozzle 44 which is a cone-shaped nozzle, the outer part 4 having a neck portion which includes a neck hole 41 and multiple paths 411 which are located around the neck hole 41, the neck portion dividing an inner space of the outer part 4 into a first room 43 and a second room 45;

a step "b" of installing a swing member 3: extending a tube 34 through the neck hole 41, a swing member 3 connected to a rear end of the tube 34, an inner part 5 connected to a front end of the tube 34, the swing member 3 including multiple wings 33 extending from an outer surface thereof, the swing member 3 including a cone-shaped way 31 defined therethrough, a Venturi-tube 12 extending through a front outlet 11 of the spray gun "A", the cone-shaped way 31 and the tube 34, and a step "c" of introducing high pressure liquid: providing a head part 2 formed to a front end of a barrel 1 of the spray gun "A", the head part 2 including multiple bores 22 which communicate with the front outlet 11 so as to introduce high pressure liquid into the first room 43 via the bores 22.

The high pressure liquid introduced in the first room 43 drives the swing member 3 to swing, and the tube 34 and the inner part 5 also swing with the swing member 3. Besides, high pressure liquid into the second room 45 via the paths 411, and the high pressure liquid introduced in the second room 45 via the paths 411 sprays from the open end 121 of the Ventrui-tube 12 and the first nozzle 44.

Figure 8:
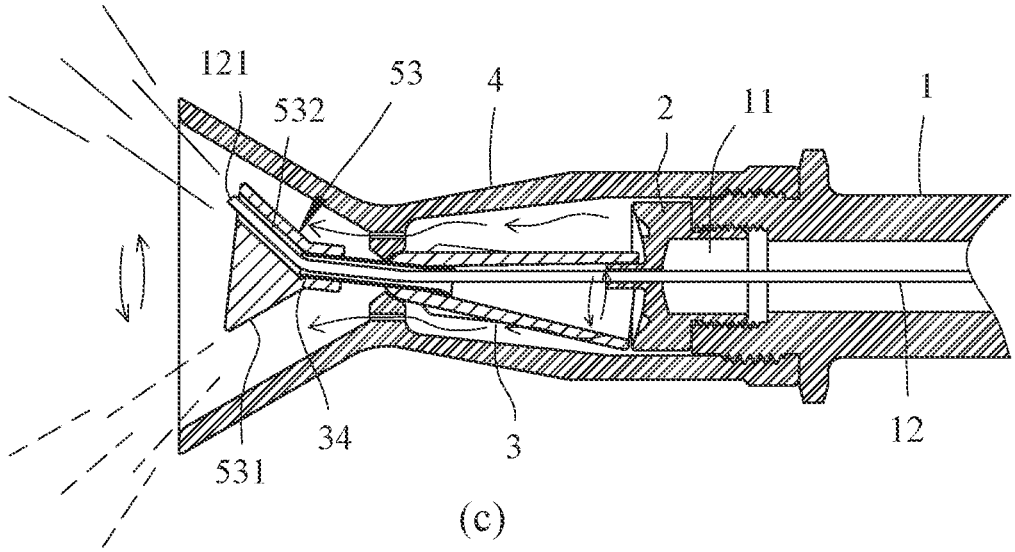
FIGS. 8 (*c*) and (*d*) show different spray patterns of the spray gun of the present invention.
Figure 8:
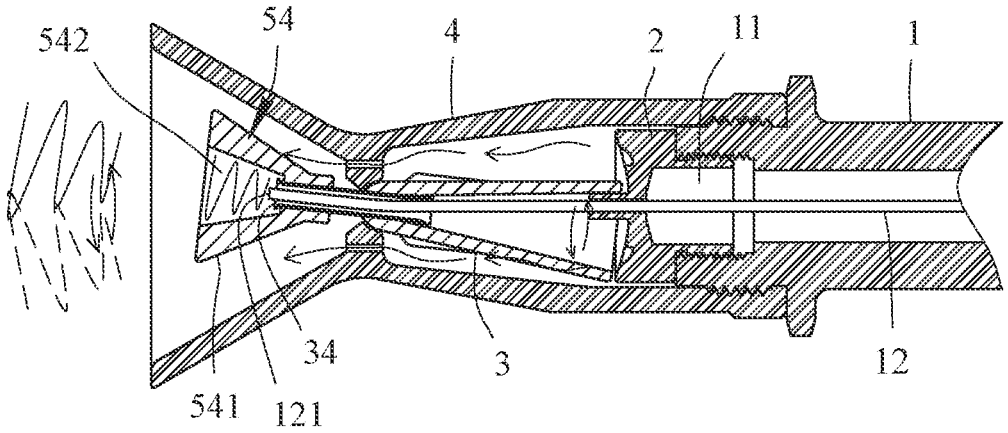
Figure 9:
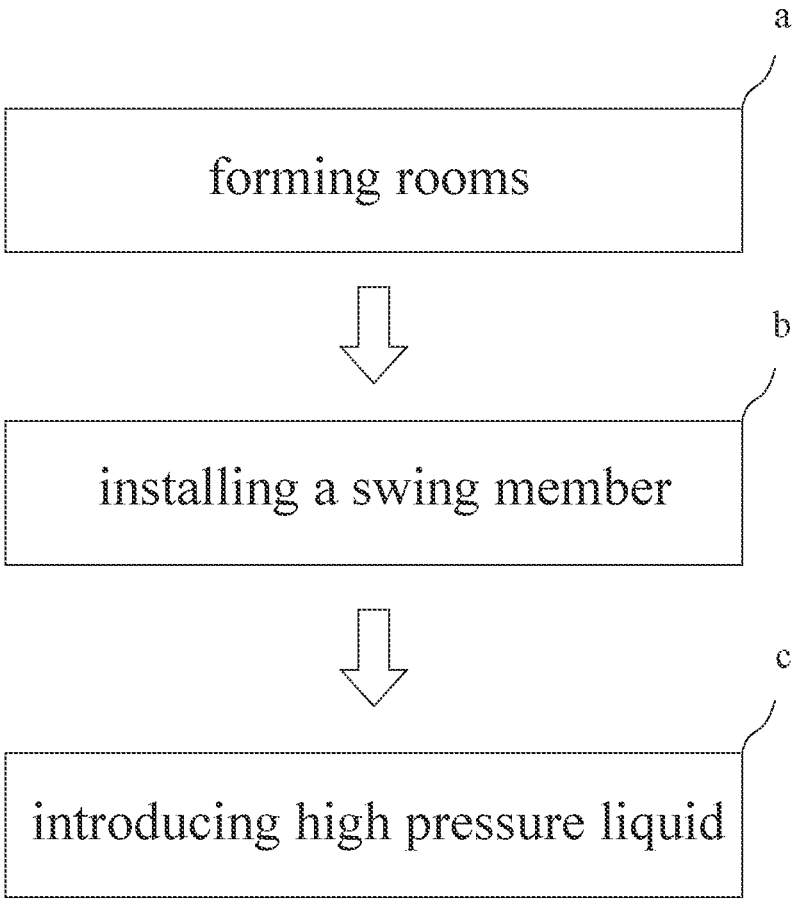
FIG. 9 shows the steps of the method of the present invention.
Figure 10:
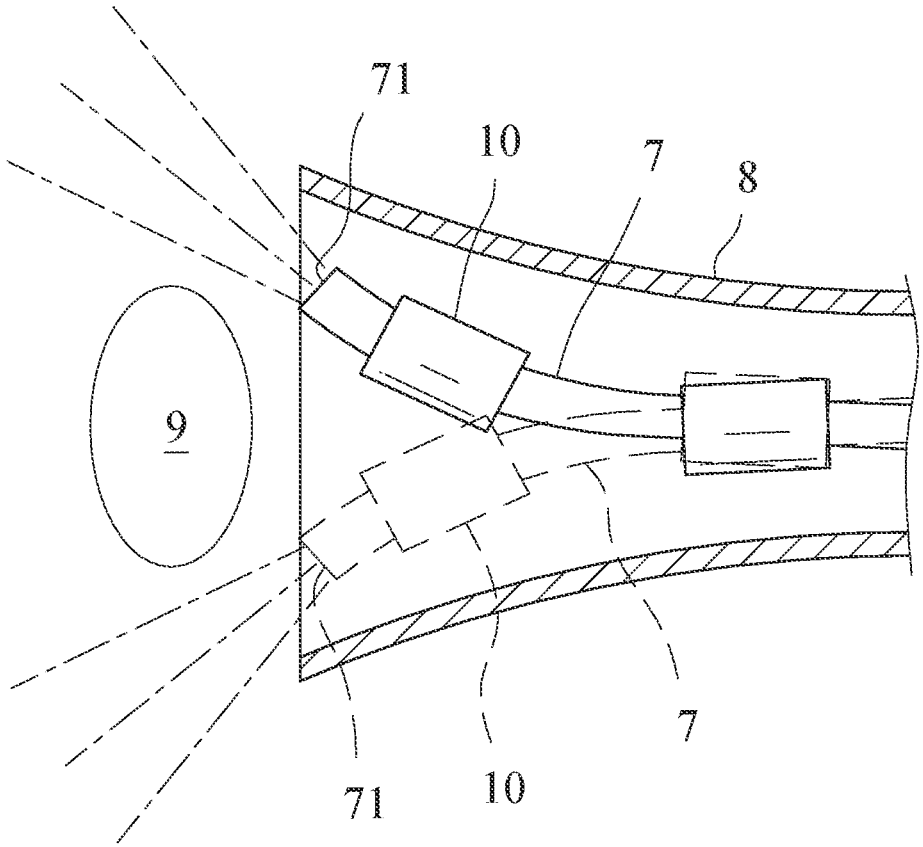
FIG.10 Prior Art
FIG. 10 shows a conventional nozzle of a spray gun.

As shown in FIGS. 7 and 8, the inner part 5 includes a second nozzle 51 which is a cone-shaped nozzle, a first cone-shaped part 52, a second cone-shaped part 53 or a third cone-shaped part 54. As shown in FIG. 7(*a*), the second nozzle 51 is connected to the front end of the tube 34 to divergently spray the liquid. As shown in FIG. 7(*b*), the first cone-shaped part 52 is a solid part 521 and includes a first passage 522, and the front end of the tube 34 is connected to the rear end of the first passage 522 so as to provide longer spray distance and small area spray features in liquid beams or atomized form. As shown in FIG. 8(*c*), the second cone-shaped part 53 is a solid part 531 and includes a second passage 532. The front end of the tube 34 is connected to the rear end of the second passage 532 so as to provide a large area spray feature in liquid beams or atomized form. As shown in FIG. 8(*d*), the third cone-shaped part 54 is a solid part 541 and includes a cone-shaped passage 542. The front end of the tube 34 is connected to the rear end of the cone-shaped passage 542 so as to provide a small area spray feature in turbulence form, liquid beams or atomized form.

It is noted that the tube 34 directly extends through the first passage 522 of the first cone-shaped part 52. The open end 121 of the Ventrui-tube 12 extends through the cone-shaped way 31 and protrudes beyond the front end of the tube 34 about 1 mm to 2 mm. The tube 34 may extend the second passage 532 of the second cone-shaped part 53 in a curved pattern. The open end 121 of the Ventrui-tube 12 extends through the cone-shaped way 31 and protrudes beyond the front end of the tube 34 about 1 mm to 2 mm so as to have better atomization feature to the liquid sprayed from the nozzle "B".

While we have shown and described the embodiment in accordance with the present invention, it should be clear to those skilled in the art that further embodiments may be made without departing from the scope of the present invention.

What is claimed is:

1. A nozzle of a spray gun, comprising:

an outer part connected to a front outlet of the spray gun and including a neck portion formed therein, a neck hole formed through the neck portion, multiple paths defined through the neck portion of the outer part and located around the neck hole, the neck portion dividing an inner space of the outer part into a first room and a second room;

a tube extending through the neck hole of the outer part, a front end of the tube located in the second room, a rear end of the tube located in the first room;

a swing member located in the first room of the outer part and connected to the rear end of the tube, and an inner part located in the second room and connected to the front end of the tube, wherein when pressurized fluid is introduced into the first room, the swing member swings responsive to a force of the pressurized fluid, and the tube and the inner part swing with the swing member, the pressurized fluid enters into the second room via the multiple paths and sprays out from the outer part.

2. The nozzle of a spray gun as claimed in claim 1, wherein the swing member includes multiple wings extending from an outer surface thereof, the swing member includes a cone-shaped way defined therethrough, a Venturi-tube extends through the front outlet of the spray gun, the cone-shaped way and the tube, the swing member includes a ball head on a front end thereof, and the neck portion includes a ball-shaped recess in which the ball head of the swing member is rotatably engaged.

3. The nozzle of a spray gun as claimed in claim 2, further comprising a head part fluidly connected to the front outlet and extending therefrom, the head part extending into the outer part, the head part includes a recessed area defined in a front end thereof, a tubular portion extends from a center of the recessed area, multiple bores are formed in the front end of the head part and located around the tubular portion so as to introduce the pressurized fluid into the first room via the bores, the tubular portion is inserted into the cone-shaped way of the swing member.

4. The nozzle of a spray gun as claimed in claim 3, wherein the bores each extend at an angle offset from an axis of the head part.

5. The nozzle of a spray gun as claimed in claim 3, wherein a first force is formed by the pressurized fluid entered into the first room via the bores, the first force drives the wings of the swing member so that the swing member swings between two points, a second force is formed by the pressurized fluid entered into the second room via the paths of the outer part, the second force sucks atomized liquid from an open end of the Venturi-tube.

6. The nozzle of a spray gun as claimed in claim 5, wherein the tube is made of metal, the open end of the Venturi-tube protrudes beyond the front end of the tube for 1 to 2 mm.

7. The nozzle of a spray gun as claimed in claim 1, wherein the outer part includes a first nozzle which is a cone-shaped nozzle.

8. The nozzle of a spray gun as claimed in claim 1, wherein the inner part includes a second nozzle which is a cone-shaped nozzle.

* * * * *